US009408778B2

(12) United States Patent
Al-Hakim

(10) Patent No.: US 9,408,778 B2
(45) Date of Patent: Aug. 9, 2016

(54) CHAMBERED MIXING BOTTLE

(71) Applicant: Muneer Al-Hakim, Macon, GA (US)

(72) Inventor: Muneer Al-Hakim, Macon, GA (US)

( * ) Notice: Subject to any disclaimer, the term of this patent is extended or adjusted under 35 U.S.C. 154(b) by 0 days.

(21) Appl. No.: 14/700,987

(22) Filed: Apr. 30, 2015

(65) Prior Publication Data

US 2016/0038378 A1 Feb. 11, 2016

Related U.S. Application Data

(60) Provisional application No. 62/034,139, filed on Aug. 6, 2014.

(51) Int. Cl.

| | |
|---|---|
| ***B65D 25/08*** | (2006.01) |
| ***A61J 9/00*** | (2006.01) |
| ***A61J 1/20*** | (2006.01) |
| ***B65D 81/32*** | (2006.01) |

(52) U.S. Cl.

CPC ..... *A61J 9/008* (2013.01); *A61J 1/2031* (2015.05); *A61J 1/2093* (2013.01); *B65D 81/3211* (2013.01); *B65D 81/3222* (2013.01)

(58) Field of Classification Search

CPC ..... A61J 1/2031; A61J 1/2093; A61J 9/00; A61J 9/008; B65D 25/08; B65D 81/3205; B65D 81/3211; B65D 81/3222; B65D 81/3233; B65D 81/3238; B65D 81/3244; B65D 81/3255

USPC ..... 206/219, 221; 215/6, DIG. 8; 366/130

See application file for complete search history.

(56) References Cited

U.S. PATENT DOCUMENTS

| | | | | |
|---|---|---|---|---|
| 3,319,837 | A * | 5/1967 | Mueller | B05B 11/004 215/6 |
| 8,672,123 | B1 | 3/2014 | Vallejo | |
| 9,187,231 | B1 * | 11/2015 | Burtner | B65D 81/3222 |
| 2009/0178940 | A1 * | 7/2009 | Said | B65D 81/3205 206/221 |
| 2010/0213085 | A1 * | 8/2010 | Belnap | A61J 1/2093 206/219 |

* cited by examiner

*Primary Examiner* — Bryon Gehman

(74) *Attorney, Agent, or Firm* — Dunlap Bennett & Ludwig PLLC

(57) ABSTRACT

A chambered bottle for separately storing wet and dry ingredients for subsequent mixing is provided. The chambered bottle may include a wet chamber, a dry chamber, a dome-shaped regulator and a drinking spout. The wet chamber and the dry chamber are interconnected by the regulator so as to be positionable in a closed configuration, for storing separated wet and dry contents, and an opened configuration whereby the wet and dry contents are mixable. The regulator provides a protrusion and a similarly shaped aperture. The wet chamber engages the regulator with a similarly dimensioned domed diaphragm providing a depression and a similarly shaped aperture. When the diaphragm and regulator apertures align, then the wet and dry contents of the wet and dry chambers, respectively, are mixed into a desired solution in the opened configuration.

10 Claims, 4 Drawing Sheets

CHAMBERED MIXING BOTTLE

CROSS-REFERENCE TO RELATED APPLICATION

This application claims the benefit of priority of U.S. provisional application No. 62/034,139, filed 6 Aug. 2014, the contents of which are herein incorporated by reference.

BACKGROUND OF THE INVENTION

The present invention relates to baby bottles and, more particularly, to a baby bottle that simultaneously and separately stores wet and dry ingredients for subsequent mixing.

Currently available baby bottles have a significant disadvantage: their design doesn't allow consumers to fix the bottle now (add water and powdered milk separately) and combine the wet and dry ingredients later. According to current design, the ingredients (water and powdered drink mixes) of the bottle have to be mixed together when being added into the bottle which means spoilage is a concern if the mixed bottle is not used immediately, because the ingredients cannot be kept separated for subsequent mixing when the consumer needs to use the resulting mixture. Some newer baby bottles tried to solve this problem but are inconvenient to use or difficult to clean.

As can be seen, there is a need for a baby bottle that simultaneously and separately stores wet and dry ingredients for subsequent mixing, whereby the device is convenient to use and easy to clean.

SUMMARY OF THE INVENTION

In one aspect of the present invention, a chambered bottle for separately storing wet and dry ingredients for subsequent mixing includes: a wet chamber forming a wet cavity for receiving wet ingredients, wherein the wet chamber defines a neck end opening and an opposing base end opening; a domed-shaped diaphragm extending from a periphery of the base end opening into the wet cavity, wherein the diaphragm provides a depression and a generally diametrically opposed diaphragm aperture; a regulator having a dome shape substantially the same as the dome-shaped diaphragm, wherein the regulator provides a protrusion and a generally diametrically opposed regulator aperture, wherein the regulator aperture, the diaphragm aperture, the regulator aperture, and the protrusion each define substantially the same shape; and a dial system configured to removably attached to the periphery of the base end opening, wherein the regulator is rotably mounted to a portion of the dial system, forming a dry cavity for receiving dry ingredients, whereby the chambered bottle is positionable in an opened configuration and a closed configuration when the protrusion engages the diaphragm aperture.

In another aspect of the invention, a chambered bottle for separately storing wet and dry ingredients for subsequent mixing includes a wet chamber forming a wet cavity for receiving wet ingredients, wherein the wet chamber defines a neck end opening and an opposing base end opening, and wherein a periphery of the base end provides threading, a domed-shaped diaphragm extending from the periphery of the base end opening into the wet cavity, wherein the diaphragm provides a depression and a generally diametrically opposed diaphragm aperture; a regulator having a dome shape substantially the same as the dome-shaped diaphragm, wherein the regulator provides a protrusion and a generally diametrically opposed regulator aperture, wherein the regulator aperture, the diaphragm aperture, the regulator aperture, and the protrusion define shapes that are each substantially the same, and wherein the protrusion and the depression each have a substantially similar depth and similar rounded corners; a seal bracket disposed along the periphery of the regulator; and a dial system including: a sheath having a base plate; and an annular sidewall perpendicularly extending from a periphery of the base plate, wherein the annular sidewalls forms a slot along a portion thereof, wherein the annular sidewall provide threading complementary of the periphery of the base end; and a dial plate rotably mounted to the base plate, wherein the dial plate having a tab flange disposed along a periphery the dial plate, wherein the tab flange is dimensioned and adapted to protrude through the slot; and a concentric annular lip disposed inward from the periphery, wherein the annular lip is dimensioned and adapted to removably affix to a periphery of the domed-shape regulator, forming a leak proof seal.

These and other features, aspects and advantages of the present invention will become better understood with reference to the following drawings, description and claims.

DETAILED DESCRIPTION OF THE INVENTION

Figure 1:
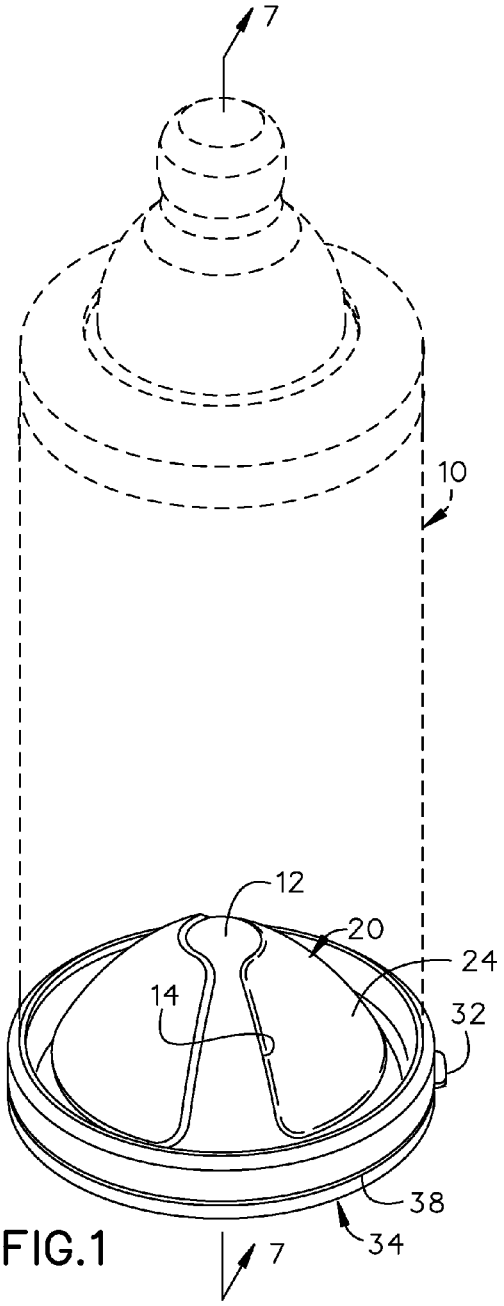
FIG. 1 is perspective view of an exemplary embodiment of the present invention, illustrating a closed configuration.
Figure 2:
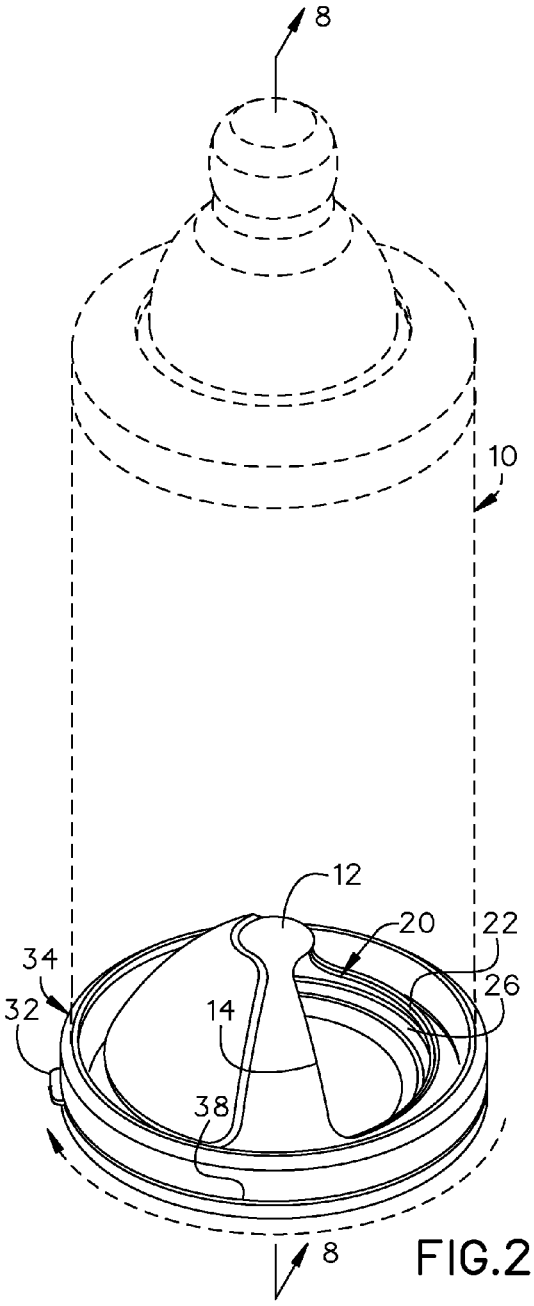
FIG. 2 is perspective view of an exemplary embodiment of the present invention, illustrating an opened configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a chambered bottle for separately storing wet and dry ingredients for subsequent mixing. The chambered bottle may include a wet chamber, a dry chamber, a dome-shaped regulator and a drinking spout. The wet chamber and the dry chamber are coupled by the regulator so as to be positionable in a closed configuration, for storing separated wet and dry contents, and an opened configuration whereby the wet and dry contents are mixable. The regulator provides a protrusion and a similarly shaped aperture. The wet chamber engages the regulator with a similarly dimensioned domed diaphragm providing a depression and a similarly shaped aperture. When the diaphragm and regulator apertures align, then the wet and dry contents of the wet and dry chambers, respectively, are mixed into a desired solution in the opened configuration.

Referring to FIGS. 1 through 8, the present invention may provide a chambered bottle 100. The chambered bottle 100 may include a wet chamber 10, a dry chamber 50, a regulator 20 and a drinking spout. The wet chamber 10 and the dry chamber 50 are coupled by the regulator 20 so as to be positionable in a closed configuration for storing separated wet and dry contents, and an opened configuration, whereby the wet and dry contents are mixable.

The wet chamber 10 is generally cylindrical body that forms a cavity for receiving wet ingredients, such as fluid, liquids, water and the like. The wet chamber 10 may terminate in a neck end and an opposing base end 18, each end providing threads or similar means of facilitating a leak-proof, detachable connection. The neck end is open and may have threads dimensioned and adapted to connect the wet chamber 10 to the drinking spout so that a user may engage the chambered bottle 100 to extract its contents. In certain embodiments, the drinking spout may include a nipple and collar. In some embodiments, the nipple may be made of medical grade silicone. In an alternative embodiment, the neck end may be closed by a cap with cooperating threads.

The base end 18 may be partially closed off by a diaphragm 12. The diaphragm 12 may be a dome-shaped structure of flexible material that separates the wet chamber 10 and the dry chamber 50. The diaphragm 12 may be made of BPA-free plastic of other suitable materials with a predetermined degree of flexibility. The diaphragm 12 dome curves upwards toward the neck end so that its superior surface forms the floor of the wet chamber 10, and the inferior surface what would be the roof of the dry chamber 50. The diaphragm 12 forms an aperture 14 and a depression 16. The depression 16 does not penetrate the diaphragm 12 material, but rather protrudes a portion of the diaphragm 12 material further into the wet chamber 10 cavity. The aperture 14 allows the wet ingredients in the wet chamber 10 cavity to pass into the dry chamber 50 with the powdered contents at the time of mixing. The aperture 14 may start near an apex of the diaphragm 12 and extend down along the diaphragm 12 material to near a periphery of the diaphragm 12 so as to be disposed over approximately 40 percent of surface area of the diaphragm 12. The depression 16 and the aperture 14 have substantially the same dimensions and are disposed diametrically opposed on the diaphragm 12.

The dry chamber 50 may be formed by the engagement of the regulator 20 and a base plate 28, thereby defining a cavity for receiving dry ingredients such as powders, granular ingredients and the like. The regulator 20 may provide a seal bracket 26 along a periphery for engaging the base plate 28. The regulator 20 may be domed and have the substantially same dimensions as the diaphragm 12. The regulator 20 may be made of BPA-free plastic of other suitable materials with the predetermined degree of flexibility. The surface of the regulator 20 may provide an aperture 22 and a protrusion 24, whereby the protrusion 24 is a raised element. The protrusion 24 is dimensioned and adapted to selectively fit into and seal off the aperture 14 on the diaphragm 12 when the chambered bottle 100 is in the closed configuration. The protrusion 24 and the aperture 14 aligned engagement is designed to maintain a leak-proof seal. The protrusion 24 is dimensioned and adapted to nest into the depression 16 of the diaphragm 12 when the chambered bottled is positioned in the open configuration. The protrusion 24, the depression 16, the aperture 22 and the aperture 14 are disposed so that when the depression 16 is nested in the protrusion 24, the apertures 14, 22 align.

Figure 7:
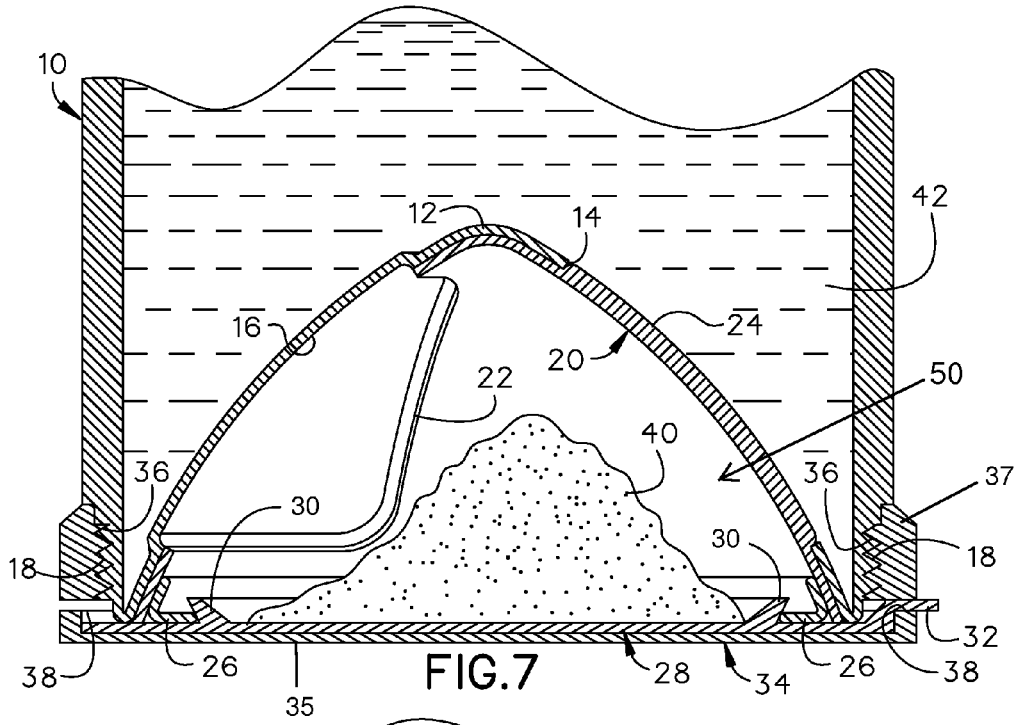
FIG. 7 a sectional view of an exemplary embodiment of the present invention in the closed configuration.
Figure 8:
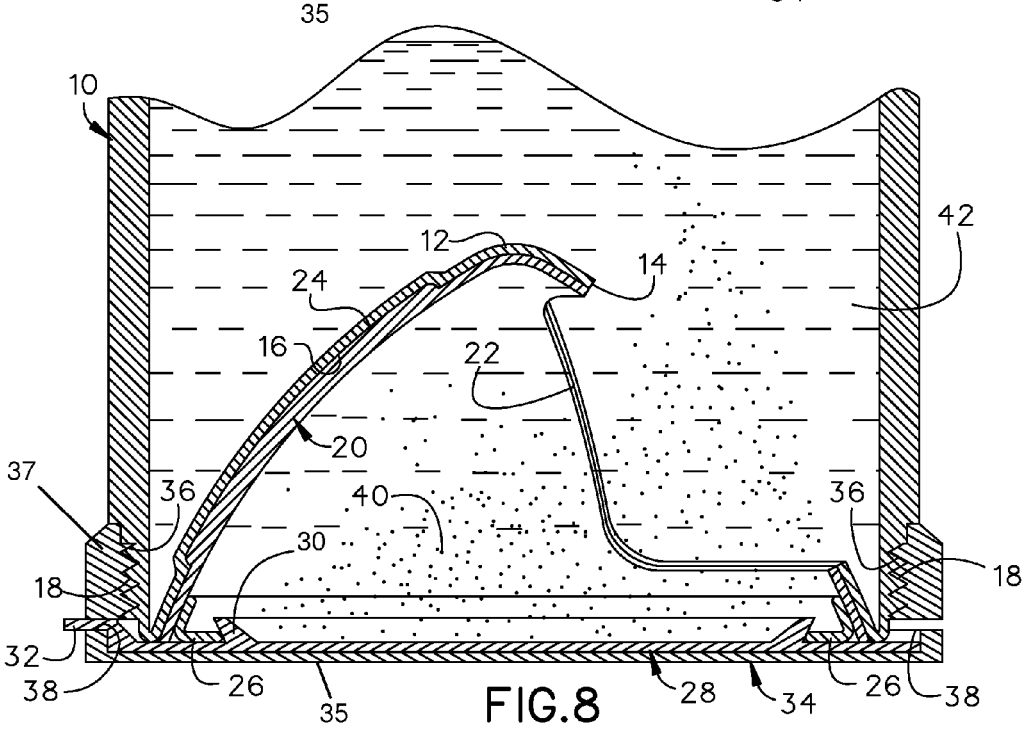
FIG. 8 a sectional view of an exemplary embodiment of the present invention in the opened configuration.

The chambered bottle 100 provides a dial system 34 that attaches along a periphery of the base end 18. The dial system 34 may include a dial plate 28 rotably mounted in a dish-shaped sheath. The sheath may include a base plate 35 and an annular sidewall 37 extending perpendicularly from a periphery thereof, as illustrated in FIGS. 7 and 8. The annular sidewall 37 may define a circumferential slot 38 along a portion thereof. The annular sidewall 37 may provide mating threads 36 dimensioned and adapted to cooperatively engage the threads of the base end 18 to form a liquid-tight seal between the base plate 38 and the wet chamber 10.

Figure 3:
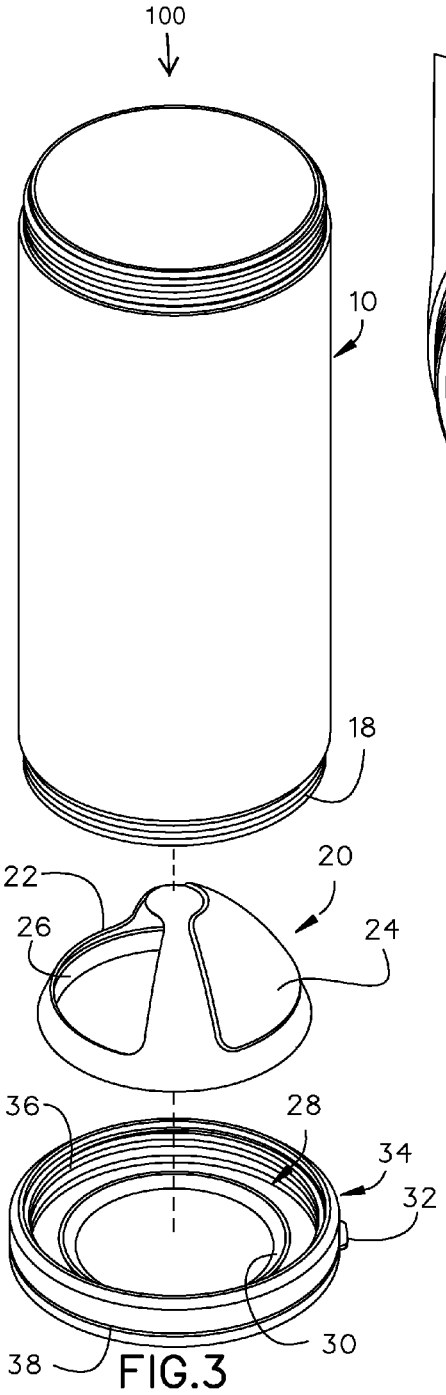
FIG. 3 an exploded view of an exemplary embodiment of the present invention.
Figure 4:
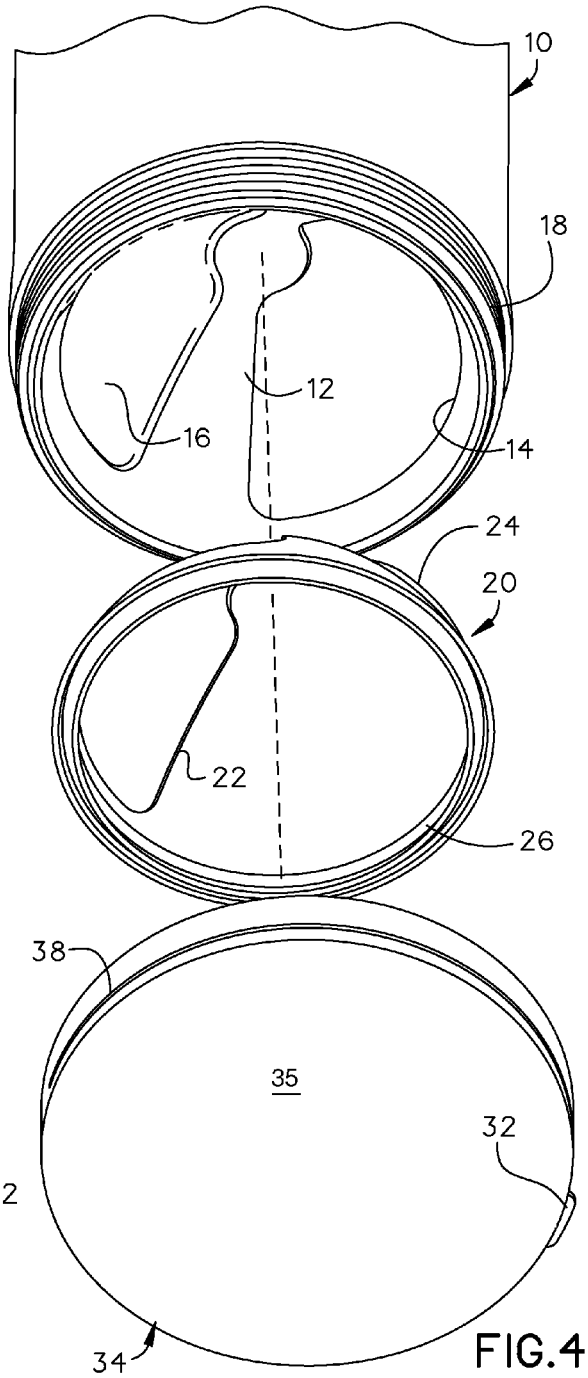
FIG. 4 an exploded view of an exemplary embodiment of the present invention.
Figure 5:
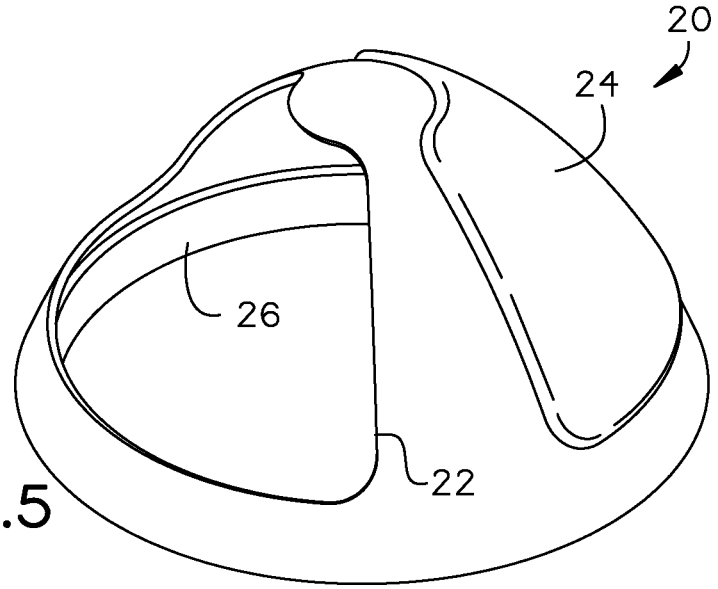
FIG. 5 a detailed perspective view of an exemplary embodiment of a regulator of the present invention.
Figure 6:
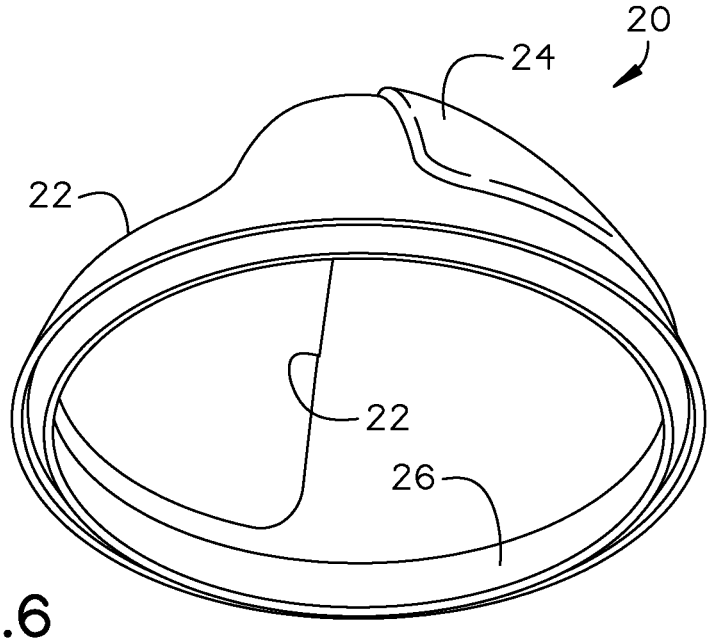
FIG. 6 a detailed perspective view of an exemplary embodiment of the regulator of the present invention.

The dial plate 28 may include a concentric annular lip 30 inset from its periphery, as illustrated in FIGS. 3, 7, 8. The annular lip 30 is dimensioned and adapted to be encircled by the seal bracket 26 so as to ("positively snap") removably affix the regulator 20 into operative engagement with the base plate 28 when forming the dry chamber 50. When the regulator 20 is rotating relative to the wet chamber 10 to position the chambered bottle 100 in its closed and opened configurations, the seal bracket 26 may be removably affixed in a groove formed by the annular lip 30 so that the dial plate 28 and regulator 20 rotate together, maintaining a liquid-tight.

The periphery of the seal plate 28 may include a tab flange 32 having a diameter greater than the annular sidewalls 28 so as to protrude through the slot 38, as illustrated in FIGS. 3, 4, 7 and 8. Since the protruding tab flange 32 is affixed to the regulator dial plate 28, which in turn is (removably) affixed to the regulator 20 by way of the seal bracket 26, as the flange manually rides the slot 38, it acts as a "dial" allowing the regulator 20 to rotate relative to the diaphragm 12 to and from the opened and the closed configurations without breaking the water-tight seal along the base end 18.

A method of using the present invention may include the following. The chambered bottle 100 disclosed above may be provided. A user may insert the regulator 20 so as to engage the diaphragm 12 so that the protrusion 24 nests into the apertures 14, the apertures 22 and depression 16 align, and so positioned in the closed configuration. With the base end 18 in an upwardly orientation, the user may place dry ingredients within the dry chamber 50. Then the user may form a seal between the annular lip 30 and the seal bracket 26 closing off the dry chamber 50. With the base end 18 in a downwardly orientation, the user may fill the wet chamber 10 with desired wet ingredients. With the neck end closed by the drinking spout or some other cap, the wet and dry contents are thereby separately stored for subsequent use, as illustrated in FIG. 7. When interested in mixing the wet and dry contents, the user may manipulate the dial system 34 to position the chambered bottle 100 into the opened configuration. In the opened configuration, the fluid from the wet chamber 10 flows with the aid of gravity into the dry chamber 50 through the aligned apertures 14, 22, as illustrated in FIG. 8. The chambered bottle may be shaken to create a desired homogeneous solution. Then the user may extract the desired homogeneous solution through the drinking spout.

It should be understood, of course, that the foregoing relates to exemplary embodiments of the invention and that modifications may be made without departing from the spirit and scope of the invention as set forth in the following claims.

What is claimed is:

1. A chambered bottle for separately storing wet and dry ingredients for subsequent mixing, comprising:

a wet chamber forming a wet cavity for receiving wet ingredients, wherein the wet chamber extends from a neck end to an opposing base end, each end defining a neck end opening and a base end opening, respectively;

a domed-shaped diaphragm extending from a periphery of the base end opening into the wet cavity, wherein the diaphragm provides a depression and a generally diametrically opposed diaphragm aperture;

a regulator having a dome shape substantially the same as the dome-shaped diaphragm, wherein the regulator provides a protrusion and a generally diametrically opposed regulator aperture, wherein the regulator aperture, the diaphragm aperture, the regulator aperture, and the protrusion each define substantially the same shape; and a dial system removably attached to the periphery of the base end opening, wherein the regulator is rotatably mounted to a portion of the dial system, forming a dry cavity for receiving dry ingredients, whereby the chambered bottle is positionable in an opened configuration and a closed configuration when the protrusion engages the diaphragm aperture.

2. The chambered bottle of claim 1, wherein the dial system comprises:

a sheath comprising:

a base plate; and an annular sidewall perpendicularly extending from a periphery of the base plate, wherein the annular sidewall forms a slot along a portion thereof; and a dial plate rotatably mounted to the base plate, wherein the dial plate comprises:

a tab flange disposed along a periphery the dial plate, wherein the tab flange is dimensioned and adapted to protrude through the slot; and a concentric annular lip disposed inward from the periphery, wherein the annular lip is dimensioned and adapted to removably affix to a periphery of the domed-shape regulator, forming a leak proof seal.

3. The chambered bottle of claim 2, further providing a seal bracket disposed along the periphery of the regulator for operatively engaging the annular lip.

4. The chambered bottle of claim 2, wherein the annular sidewall and the periphery of the base end provide complementary threading.

5. The chambered bottle of claim 1, wherein the neck end provides threading, and further providing a cap having threading complementary of the neck end.

6. The chambered bottle of claim 5, further providing a nipple and collar, wherein the collar provides threading complementary of the neck end.

7. The chambered bottle of claim 1, wherein the wet chamber is tubular.

8. The chambered bottle of claim 1, wherein the diaphragm aperture is disposed over approximately 40 percent of the diaphragm.

9. The chambered bottle of claim 1, wherein the protrusion and the depression each have a substantially similar depth and similar rounded corners.

10. A chambered bottle for separately storing wet and dry ingredients for subsequent mixing, comprising:

a wet chamber forming a wet cavity for receiving wet ingredients, wherein the wet chamber extends from a neck end to an opposing base end, each end defining a neck end opening and a base end opening, respectively, and wherein a periphery of the base end provides threading;

a domed-shaped diaphragm extending from the periphery of the base end opening into the wet cavity, wherein the diaphragm provides a depression and a generally diametrically opposed diaphragm aperture;

a regulator having a dome shape substantially the same as the dome-shaped diaphragm, wherein the regulator provides a protrusion and a generally diametrically opposed regulator aperture, wherein the regulator aperture, the diaphragm aperture, the regulator aperture, and the protrusion define shapes that are each substantially the same, and wherein the protrusion and the depression each have a substantially similar depth and similar rounded corners;

a seal bracket disposed along the periphery of the regulator; and a dial system comprising:

a sheath comprising:

a base plate; and an annular sidewall perpendicularly extending from a periphery of the base plate, wherein the annular sidewall forms a slot along a portion thereof, wherein the annular sidewall provides threading complementary of the periphery of the base end; and a dial plate rotatably mounted to the base plate, wherein the dial plate comprises:

a tab flange disposed along a periphery of the dial plate, wherein the tab flange is dimensioned and adapted to protrude through the slot; and a concentric annular lip disposed inward from the periphery, wherein the annular lip is dimensioned and adapted to removably affix to a periphery of the domed-shape regulator, forming a leak proof seal.

* * * * *